US008291517B2

(12) United States Patent
Taliento et al.

(10) Patent No.: US 8,291,517 B2
(45) Date of Patent: Oct. 23, 2012

(54) CORRECT GRIP SPORTS GLOVE

(75) Inventors: Frank Taliento, West Hills, CA (US); Guy Levy, West Hills, CA (US)

(73) Assignee: Levitee LLC, Woodland Hills, CA (US)

( * ) Notice: Subject to any disclaimer, the term of this patent is extended or adjusted under 35 U.S.C. 154(b) by 811 days.

(21) Appl. No.: 12/154,182

(22) Filed: May 19, 2008

(65) Prior Publication Data

US 2008/0282445 A1 Nov. 20, 2008

Related U.S. Application Data

(60) Provisional application No. 60/938,511, filed on May 17, 2007.

(51) Int. Cl.
*A41D 19/00* (2006.01)

(52) U.S. Cl. ..... 2/161.1; 2/159; 2/160; 2/161.2; 2/163

(58) Field of Classification Search ..... 2/20, 21, 2/159, 160, 161.1, 161.6, 163
See application file for complete search history.

(56) References Cited

U.S. PATENT DOCUMENTS

| | | | | |
|---|---|---|---|---|
| 2,285,981 | A * | 6/1942 | Johns | 2/21 |
| 2,884,644 | A * | 5/1959 | Jefferson | 2/158 |
| 3,290,695 | A * | 12/1966 | Burtoff | 2/161.8 |
| 4,766,612 | A * | 8/1988 | Patton, Sr. | 2/16 |
| 5,309,573 | A * | 5/1994 | Solar et al. | 2/160 |
| 5,367,711 | A * | 11/1994 | Calagui | 2/161.6 |
| 5,590,421 | A * | 1/1997 | Craner | 2/161.7 |
| 5,600,853 | A * | 2/1997 | Yewer, Jr. | 2/161.1 |
| 5,604,934 | A * | 2/1997 | Willett | 2/161.1 |
| 5,608,912 | A | 3/1997 | Cumberland | 2/16 |
| 5,636,381 | A * | 6/1997 | Brogden | 2/161.1 |
| 5,970,521 | A * | 10/1999 | Rabbeth | 2/161.1 |
| 6,000,059 | A * | 12/1999 | Abts | 2/161.6 |
| 6,351,867 | B1 * | 3/2002 | Forster | 15/121 |

(Continued)

FOREIGN PATENT DOCUMENTS

GB 2089197 A * 6/1982

(Continued)

OTHER PUBLICATIONS

PCT Written Opinion & International Search Report for International Application No. PCT/US2008/012927 mailed on Mar. 31, 2009.

*Primary Examiner* — Khoa Huynh
*Assistant Examiner* — Sally Haden
(74) *Attorney, Agent, or Firm* — Koppel, Patrick, Heybl & Philpott; Michael J. Ram

(57) ABSTRACT

A glove for sports and other uses is provided comprising a palm portion configured to substantially cover a user's palm and palm side surface of the user's fingers and thumb, and a back portion configured to substantially cover the back of a user's hand and back surface of the user's fingers and thumb. One or more inserts are provided between at least two of the fingers, with the inserts webbing the fingers together and spacing them apart. Alternatively, one or more inserts are provided between at least two of the fingers, with the inserts spacing the fingers apart without webbing them together. The inserts assist in improving the grip of the user. They are also beneficial for aiding in the absorption of shock.

13 Claims, 3 Drawing Sheets

U.S. PATENT DOCUMENTS

| | | | | |
|---|---|---|---|---|
| 6,415,443 | B1 * | 7/2002 | Schierenbeck et al. | 2/159 |
| 6,427,246 | B1 * | 8/2002 | Doi et al. | 2/161.1 |
| 6,665,874 | B2 * | 12/2003 | Stolf | 2/21 |
| 6,772,441 | B2 | 8/2004 | Lucas, Jr. | 2/161.1 |
| 7,007,308 | B1 * | 3/2006 | Howland et al. | 2/161.6 |
| 7,421,787 | B2 * | 9/2008 | White et al. | 30/123 |
| 7,707,653 | B2 * | 5/2010 | Kleinert | 2/161.1 |
| 2005/0028244 | A1 * | 2/2005 | Roeckl | 2/161.1 |
| 2005/0114982 | A1 * | 6/2005 | Gremmert | 2/159 |
| 2005/0223469 | A1 * | 10/2005 | Banton | 2/160 |
| 2007/0044202 | A1 * | 3/2007 | Park | 2/161.6 |
| 2007/0061943 | A1 * | 3/2007 | Kleinert | 2/159 |
| 2007/0226874 | A1 * | 10/2007 | Cain | 2/159 |
| 2012/0017352 | A1 * | 1/2012 | Waddell | 2/161.1 |
| 2012/0030856 | A1 * | 2/2012 | Bevier | 2/161.1 |
| 2012/0042429 | A1 * | 2/2012 | Zare | 2/20 |

FOREIGN PATENT DOCUMENTS

GB 2267023 A * 11/1993

* cited by examiner

CORRECT GRIP SPORTS GLOVE

This application claims the benefit of provisional application Ser. No. 60/938,511 to Frank Taliento et al., which was filed on May 17, 2007.

BACKGROUND OF THE INVENTION

1. Field of the Invention

The present invention relates to gloves, and more particularly to sports gloves having inserts between the fingers.

2. Description of the Related Art

Gloves for sports such as golf and baseball, where the user must grip a club, bat, or the like, are well known in the art. Various gloves have been developed for protection of the hand and to allow for improved gripping. However, many gloves are used in sports where the grip of the user is crucial to performance. For example, when a golfer grips a golf club, it is preferable for the golfer to maintain a relaxed grip such that the fingers are evenly spaced apart. It is also important for the golfer to use a glove that is sufficiently flexible, breathable and thin, such that dexterity, comfort and tactile feel are maintained. Current gloves may provide for improved dexterity, breath-ability and tactile feel, but do not provide a means for improving the grip of the user by spacing the fingers apart.

Additionally, gloves are often used in situations when the user's hand and fingers may experience a great deal of shock or strain. For example, a golfer's hands and fingers can experience shock and strain when the golfer swings a club and the club is brought into connection with a ball. It is thus desirable to provide a glove that can sufficiently absorb some of that shock so unnecessary hand and finger strain can be avoided.

SUMMARY OF THE INVENTION

The present invention seeks to provide a glove for improving the grip of the user and absorbing shock to the hand, with the glove being durable, breathable, sufficiently flexible, and customizable. One embodiment of a glove according to the present invention comprises a palm portion configured to substantially cover a user's palm and palm side surface of the user's fingers and thumb, and a back portion configured to substantially cover the back of a user's hand and back surface of the user's fingers and thumb. One or more inserts are provided between at least two of the fingers, with the inserts webbing the fingers together and spacing them apart.

Another embodiment of a glove according to the present invention comprises a palm portion configured to substantially cover a user's palm and palm side surface of the user's fingers and thumb, and a back portion configured to substantially cover the back of a user's hand and back surface of the user's fingers and thumb. One or more inserts are provided between at least two of the fingers, with the inserts spacing the fingers apart without webbing them together.

Another embodiment of a sports glove according to the present invention comprises a palm portion configured to substantially cover a user's palm, a back portion configured to substantially cover the back of a user's hand, finger portions configured to substantially cover the fingers of a user's hand, and a thumb portion configured to substantially cover the thumb of a user's hand. Inserts are provided between each of the fingers of the user's hand, with the inserts spacing the fingers apart.

These and other further features and advantages of the invention would be apparent to those skilled in the art from the following detailed description, taken together with the accompanying drawings, in which:

DETAILED DESCRIPTION OF THE INVENTION

The present invention provides a glove for improving the grip of the user and absorbing shock to the hand and fingers. This results in a sports glove comprising inserts between at least two of the fingers of a hand. The present invention is generally directed to gloves used for sports, but it is understood that the gloves may be appropriate for a number of applications.

Figure 1:
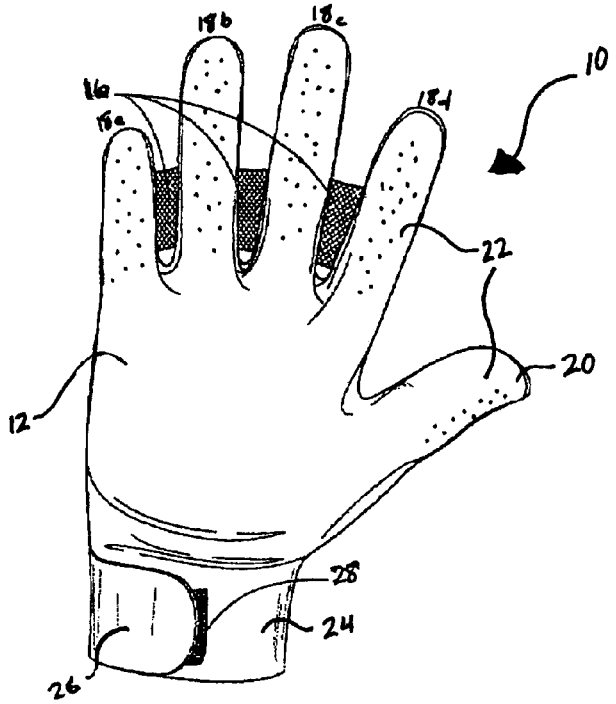
FIG. 1 is a plan view of one embodiment of a glove according to the present invention, shown from the back side of the glove.
Figure 2:
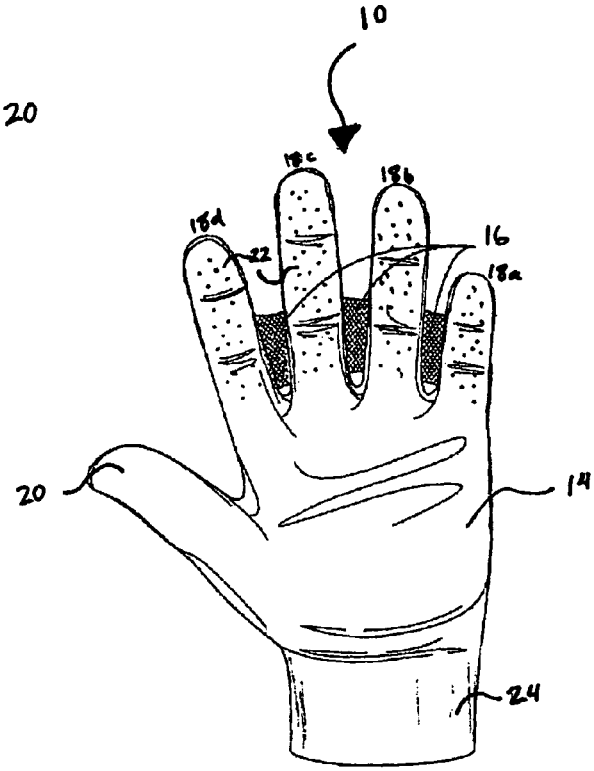
FIG. 2 is a plan view of the embodiment shown in FIG. 1, shown from the palm side of the glove.
Figure 3:
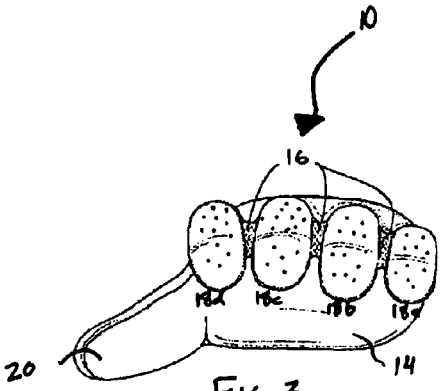
FIG. 3 is a plan view of the embodiment shown in FIG. 1, shown from the fingertips of the glove.

FIGS. 1-3 show one embodiment of a glove 10 according to the present invention, generally comprising a back portion 12 that substantially covers the back of the user's hand, fingers, and thumb. The back portion 12 can be formed from many different materials, with a suitable material being leather, synthetic leather, heavy mesh, or Lycra®. The material is suited to protect the back of the user's hand while allowing for freer movement, ease of finger bending, comfort, and durability. The back portion 12 may comprise pieces of material joined together, and can also be a combination of heavy mesh, Lycra®, leather, synthetic leather, and/or other suitable materials, and can also include padding where appropriate.

The glove 10 also includes a palm portion 14 that substantially covers the user's palm and palm side surface of the fingers. The palm is preferably made of leather, synthetic leather, heavy mesh, or Lycra®, although it is understood that other suitable materials may also be used. The palm portion 14 may comprise pieces of material joined together, and can also be a combination of heavy mesh, Lycra®, leather, synthetic leather, and/or other suitable materials, and can also include padding where appropriate.

Inserts 16 are included between at least two of the fingers, spacing at least two of the fingers apart while also webbing them together. The inserts 16 may be stitched into a piece of material prior to being attached between the fingers. Alternatively, inserts 16 may be included between the fingers without being covered by any additional material. Inserts 16 may be connected between at least two of the fingers by sewing them into the material between the fingers. Alternatively, inserts 16 may be connected between at least two of the fingers by using a suitable adhesive such as glue or by placing them in pockets between the fingers formed specifically to accept the inserts (not shown).

The inserts 16 may comprise a number of different shapes, with some suitable shapes including ovals and wedges. Inserts 16 are preferably made from a material that is sufficiently supple and yielding, such as any number of gels, silicon, rubber, or foam, although it is understood that many materials are suitable.

The inserts 16 provide at least three advantages. One such advantage is to space apart at least two of the fingers such that the fingers are properly spaced apart when the user is gripping an item like a golf club or baseball bat. Properly spacing apart the fingers allows the user to maintain a proper grip while also relaxing the fingers, which can result in improved performance. Another advantage is to provide a means of shock absorption between at least two of the fingers, such that when a user is gripping an item such as a golf club or a baseball bat, the shock resulting when the ball connects with the club or bat can at least partially be absorbed by the inserts 16 between the fingers. An additional advantage is to provide improved comfort to the user. The inserts 16 pad the spaces between at least two of the fingers so that any discomfort resulting from contact of adjacent fingers is significantly reduced.

Separate Finger sections 18*a*, 18*b*, 18*c*, 18*d* , enclosing each of a user's fingers may be an extension of either the back portion 12 or palm portion 14 of the glove 10, or both. Alternatively, finger sections 18*a*, 18*b*, 18*c*, 18*d* can be separate portions from back portion 12 or palm portion 14, such that they are stitched separately to the remainder of the glove. Finger sections 18*a*, 18*b*, 18*c*, 18*d* may cover substantially all of the fingers, or may only partially cover the fingers such that the fingertips are left uncovered. Alternatively, sections 18*a*, 18*b*, 18*c*, 18*d* may cover the surfaces running between the saddle of adjacent fingers, such that they are attached to the glove to combine back portion 12 and palm portion 14. Finger sections 18*a*, 18*b*, 18*c*, 18*d* can be made of heavy mesh, Lycra®, leather, synthetic leathers, or any combination thereof, although it is understood that other suitable materials may also be used.

Thumb section 20 may likewise be an extension of either the back portion 12 or palm portion 14 of the glove 10, or both. Alternatively, thumb section 20 can be a separate portion from back portion 12 or palm portion 14, such that it is stitched separately to the remainder of the glove. Thumb section 20 may cover substantially all of the thumb, or may only partially cover the thumb such that the tip of the thumb is left uncovered. Thumb section 20 can be made of heavy mesh, Lycra®, leather, synthetic leather, or any combination thereof, although it is understood that other suitable materials may also be used.

Fingers sections 18*a*, 18*b*, 18*c*, 18*d* and thumb section 20 may comprise vent holes 22 to allow air to pass through the glove and enhance the breath-ability of the glove. Alternatively, vent holes can be added to the back portion 12 or palm portion 14 of the glove to enhance breath-ability (not shown). Another option for enhancing breath-ability is to provide a glove material for all or some of the portions that is inherently breathable.

Glove 10 may also comprise a wrist portion 24 that is adjacent to back and palm portions 12 and 14, which is configured to encircle the user's wrist to help secure the glove. In one embodiment according to the present invention, the wrist portion 24 comprises an elastic material. The wrist portion 24 may also include a wrist closure tab 26 that closes the wrist portion 24 around the user's wrist and is held in place by a Velcro portion 28. The closure tab 26 and Velcro portion 28 can act together to tighten or loosen the glove at the wrist according to the user's preference. Alternatively, a wrist portion 24 can include a closure strap that closes the wrist section around the user's wrist and is held in place by a hook and loop closure (not shown). It is understood that many additional, suitable means of closure about the wrist portion can also be utilized.

All parts of the glove 10 are connected together using a sewn inseam. However, it is understood that other methods of joining the various portions together may also be used, including using an outer seam or using an adhesive such as glue.

Figure 4:
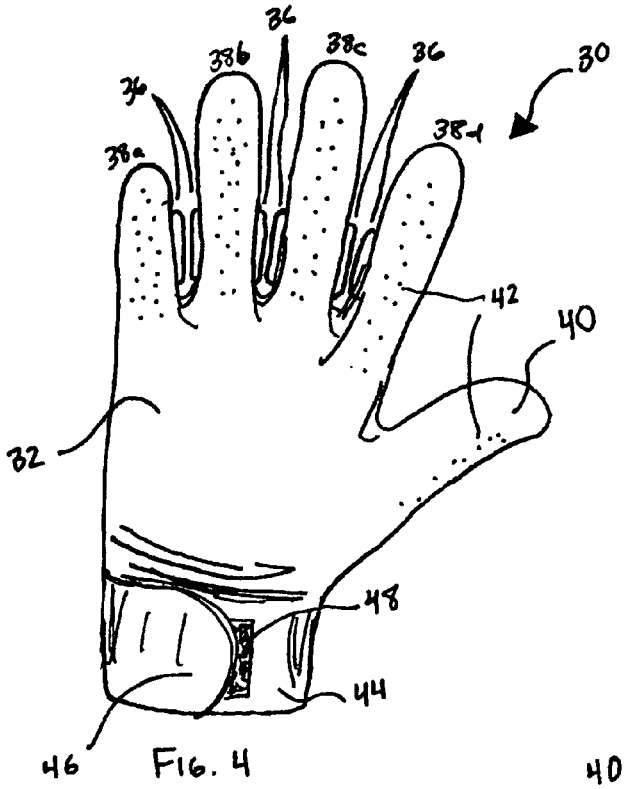
FIG. 4 is a plan view of another embodiment of a glove according to the present invention, shown from the back side of the glove.
Figure 5:
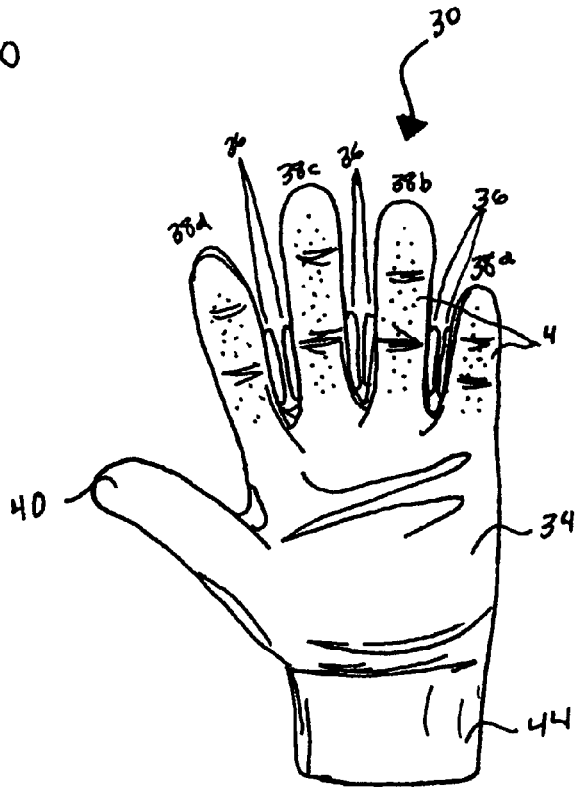
FIG. 5 is a plan view of the embodiment shown in FIG. 4, shown from the palm side of the glove.
Figure 6:
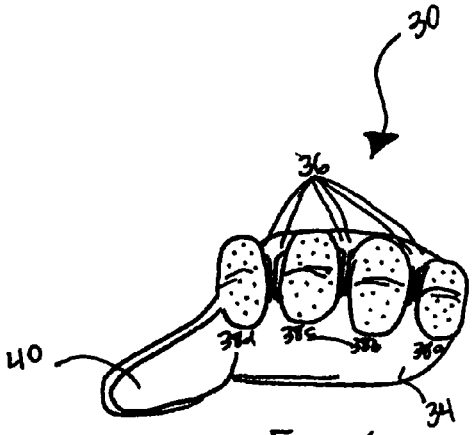
FIG. 6 is a plan view of the embodiment shown in FIG. 4, shown from the fingertips of the glove.

FIGS. 4-6 show another embodiment of a glove 30 similar to the glove 10 depicted in FIGS. 1-3, having back portion 32, palm portion 34, finger portions 38*a*, 38*b*, 38*c*, 38*d*, thumb portion 40, vent holes 42, wrist portion 44, wrist closure 46, and Velcro portion 48. However, FIGS. 4-6 depict different inserts 36, which are provided between at least two of the fingers to space them apart without webbing them together. At least two of the inserts 36 may be included between adjacent fingers as shown. Alternatively, only one of inserts 36 may be placed between adjacent fingers such that the insert is not connected to at least one of the fingers on one side (best shown in FIG. 12). The inserts 36 may be stitched into a piece of material prior to being attached between the fingers. Alternatively, inserts 36 may be included between the fingers without being covered by any additional material. Inserts 36 may be connected between at least two of the fingers by sewing them into the material between the fingers. Alternatively, inserts 36 may be connected between at least two of the fingers by using a suitable adhesive such as glue or by placing them in pockets between the fingers formed specifically to accept the inserts (not shown).

Like inserts 16, the inserts 36 may comprise a number of different shapes, with some suitable shapes including ovals and wedges. Additionally, inserts 36 are preferably made from a material that is sufficiently supple and yielding, such as any number of gels, silicon, rubber, or foam, although it is understood that many materials are suitable.

In addition to the advantages listed above in connection with inserts 16, inserts 36 provide the advantage of allowing the user to spread apart the fingers in situations where greater finger mobility is desired. Apart from the inserts 36 not webbing the fingers together, it is understood that all other elements of glove 30 function and interact in the same ways as described above with respect to glove 10.

Figure 7:
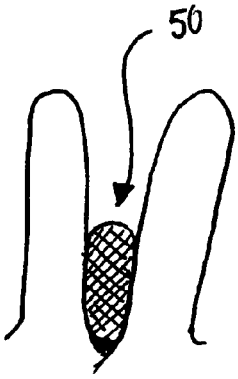
FIG. 7 is a plan view of one embodiment of an insert for a glove according to the present invention.
Figure 8:
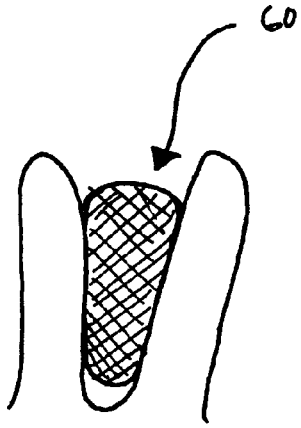
FIG. 8 is a plan view of another embodiment of an insert for a glove according to the present invention.
Figure 9:
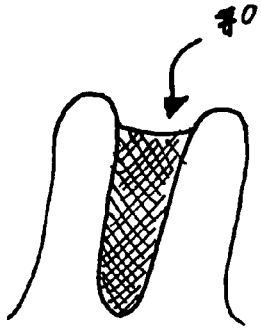
FIG. 9 is a plan view of another embodiment of an insert for a glove according to the present invention.

FIGS. 7-12 show a number of possible embodiments for a glove insert according to the present invention. FIGS. 7-9 depict inserts 50, 60, and 70 respectively, all of which are designed to separate the fingers while also webbing them together. Insert 50 is an oval shaped insert that sits all the way at the bottom of the saddle region formed between adjacent fingers, while only going part of the way up the area between the fingers. Wedge-shaped insert 60 goes substantially all of the way up the area between adjacent fingers, but does not sit all of the way at the bottom of the saddle region formed between adjacent fingers. Insert 70 encompasses substantially all of the area between adjacent fingers. While inserts 50, 60, and 70 represent some possible, preferred embodiments of inserts that can be used to separate the fingers while webbing them together, it is understood that a number of different insert types can be used.

Figure 10:
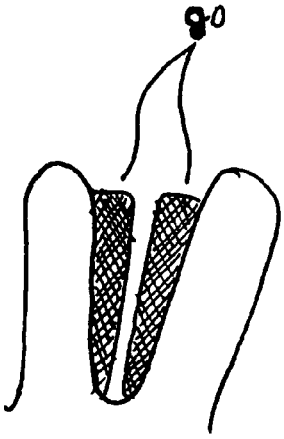
FIG. 10 is a plan view of another embodiment of an insert for a glove according to the present invention.
Figure 11:
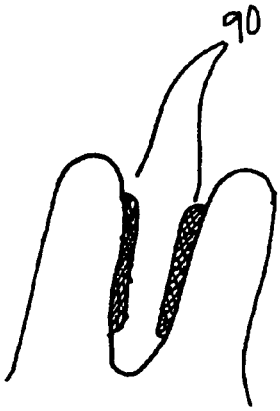
FIG. 11 is a plan view of another embodiment of an insert for a glove according to the present invention.
Figure 12:
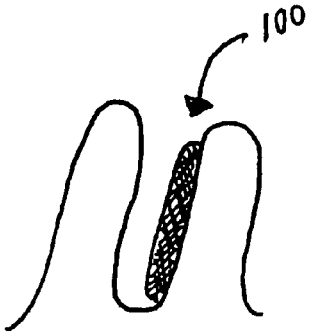
FIG. 12 is a plan view of another embodiment of an insert for a glove according to the present invention.

FIGS. 10-12 depict inserts 80, 90, and 100 respectively, all of which are designed to separate the fingers while not webbing them together. Inserts 80 are generally wedge-shaped and go up substantially all of the way up the fingers. Inserts 90 are generally oval-shaped and only partially go up the fingers. Insert 100 is generally oval-shaped, and is only provided on one of the finger surfaces between adjacent fingers. While inserts 80, 90, and 100 represent some possible, preferred embodiments of inserts that can be used to separate the fingers while also allowing them to remain separated, it is understood that a number of different insert types can be used.

Although the present invention has been described in considerable detail with reference to certain preferred configurations thereof, other versions are possible. The inserts can be used in many different types of gloves, and the gloves may be utilized for a number of varying purposes. The inserts can also have many different shapes and can be connected to the gloves in many different ways. Accordingly, the spirit and scope of the invention should not be limited to the preferred versions of the invention described above.

We claim:

1. A glove, comprising:

a palm portion configured to substantially cover a user's palm and palm side surface of the user's fingers and thumb;

a back portion configured to substantially cover the back of a user's hand and back surface of the user's fingers and thumb;

four separate finger sections enclosing each of the user's fingers, wherein each of the finger sections is separated by a space;

one or more inserts positioned entirely only in said spaces between at least two of the finger sections, said inserts spacing the at least two finger sections apart without webbing said at least two finger sections together; and vent holes along at least portions of said glove.

2. The glove of claim 1, further comprising a wrist portion configured to encircle the user's wrist and secure the glove.

3. The glove of claim 2, wherein said wrist portion is secured with a tab and hook and loop enclosure.

4. The glove of claim 1, further comprising finger sections which run between each of the user's fingers.

5. The glove of claim 1, wherein said inserts are sewn into a piece of material such that they are covered by said material.

6. The glove of claim 1, wherein said inserts are connected to the inside surface of at least one finger via sewing, adhesive, or pockets.

7. The glove of claim 1, wherein said back and palm portions are at least partially comprised of a durable and flexible material.

8. The glove of claim 1, wherein said inserts are comprised of a supple material.

9. The glove of claim 1, wherein said inserts assist in shock absorption.

10. The glove of claim 1, wherein said inserts assist in improving the grip of the user.

11. The glove of claim 1, wherein said vent holes are included to make the glove more breathable and to aid in cooling the user's hand.

12. A grip correcting sports glove, comprising:

a palm portion configured to substantially cover a user's palm;

a back portion configured to substantially cover the back of a user's hand;

four separate finger portions configured to substantially cover the fingers of a user's hand;

a thumb portion configured to substantially cover the thumb of a user's hand;

inserts integral with the finger portions at a location entirely only between each of the finger portions, said inserts spacing the finger portions apart and aiding in shock absorption; and vent holes along at least portions of said glove.

13. The glove of claim 12, wherein said vent holes are included along portions of said palm, back, finger, and thumb portions to make the glove more breathable and to aid in cooling the user's hand.

* * * * *